United States Patent [19]

Frattolillo

[11] Patent Number: 4,631,045

[45] Date of Patent: Dec. 23, 1986

[54] APPARATUS FOR PRODUCING A ROD-LIKE SMOKING ARTICLE WITH SECONDARY AIR CHANNELS

[75] Inventor: Antonio P. A. Frattolillo, Boudry, Switzerland

[73] Assignee: Fabriques de Tabac Reunies, S.A., Neuchatel, Switzerland

[21] Appl. No.: 815,116

[22] Filed: Dec. 27, 1985

Related U.S. Application Data

[60] Continuation of Ser. No. 744,804, Jun. 14, 1985, abandoned, which is a continuation of Ser. No. 644,073, Aug. 24, 1984, abandoned, which is a division of Ser. No. 348,571, Feb. 12, 1982, Pat. No. 4,498,487.

[30] Foreign Application Priority Data

Feb. 14, 1981 [DE] Fed. Rep. of Germany ..... 3105456

[51] Int. Cl.[4] ..... B31C 13/00

[52] U.S. Cl. ..... 493/46; 493/42; 493/39; 493/60; 493/355; 493/370; 131/361; 131/336; 131/339; 131/198.1

[58] Field of Search ..... 493/60, 241, 279, 280, 493/228, 355, 160, 266, 41, 39, 42, 46, 49, 370, 463, 464; 131/336, 361, 362, 363, 339, 340, 338, 198 R, 216, 224

[56] References Cited

U.S. PATENT DOCUMENTS

| | | | |
|---|---|---|---|
| 2,089,898 | 8/1937 | Kappler | 493/463 |
| 3,052,163 | 9/1962 | Schubert | 493/39 |
| 3,607,512 | 9/1971 | Mathe | 131/340 |
| 3,638,661 | 2/1972 | Pinkham | 493/39 |
| 3,855,032 | 12/1976 | Luke | 493/39 |
| 4,050,362 | 9/1977 | Schröter | 493/370 |
| 4,362,172 | 12/1982 | Johnson | 131/336 |
| 4,425,106 | 1/1984 | Boegll et al. | 493/49 |
| 4,471,515 | 9/1984 | Takenaka et al. | 493/463 |

FOREIGN PATENT DOCUMENTS

| | | | |
|---|---|---|---|
| 1207890 | 2/1960 | France | 493/60 |

*Primary Examiner*—Francis S. Husar
*Assistant Examiner*—David B. Jones
*Attorney, Agent, or Firm*—Jeffrey H. Ingerman

[57] ABSTRACT

A rod-like smoking article with a rod-like mouthpiece core at the mouth end of a tobacco rod, the entire periphery of said mouthpiece core being enveloped by an adhered wrapping paper which is suitable for contact with the lips and which overlappingly follows a covering paper surrounding the tobacco rod and with secondary air channels covered by the wrapping paper on the periphery of the mouthpiece core and an apparatus for producing such an article.

4 Claims, 29 Drawing Figures

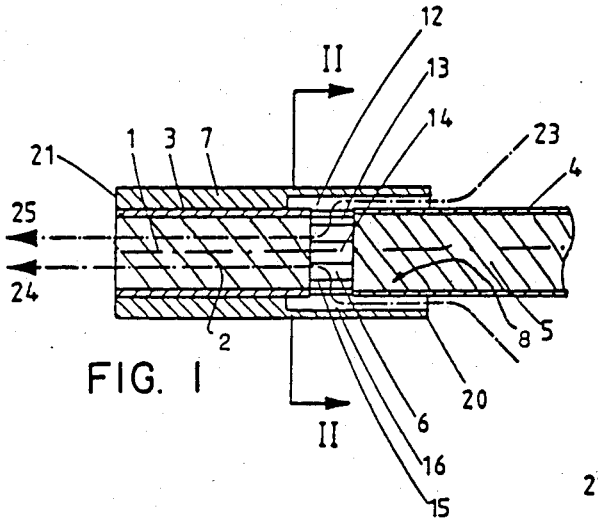
FIG. 1
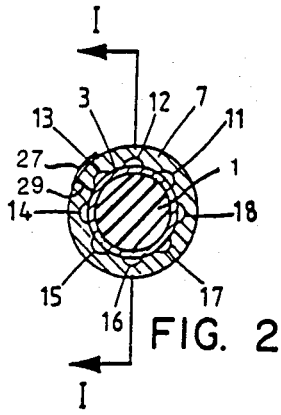
FIG. 2
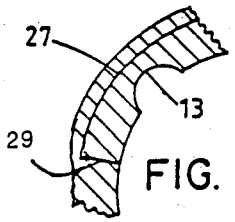
FIG. 2A
FIG. 3
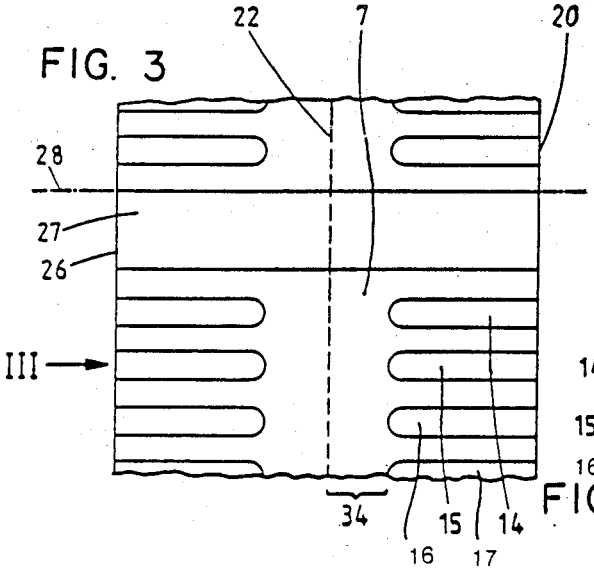
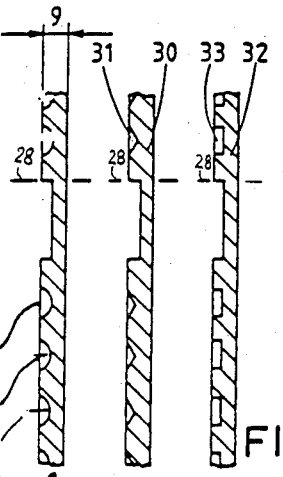
FIG. 4 FIG. 5 FIG. 6

APPARATUS FOR PRODUCING A ROD-LIKE SMOKING ARTICLE WITH SECONDARY AIR CHANNELS

This is a continuation of application Ser. No. 744,894, filed June 14, 1985, now abandoned entitled ROD-LIKE SMOKING ARTICLE WITH SECONDARY AIR CHANNELS AND APPARATUS FOR PRODUCING SUCH AN ARTICLE, which is a continuation of application Ser. No. 644,073, filed Aug. 24, 1984, now abandoned, which was a division of application Ser. No. 348,571, filed Feb. 12, 1982, now U.S. Pat. No. 4,498,487.

BACKGROUND OF THE INVENTION

The invention relates to a rod-like smoking article with a rod-like mouthpiece core at the mouth end of a tobacco rod, the entire periphery of said mouthpiece core being enveloped by an adhered wrapping paper which is suitable for contact with the lips and which overlappingly follows a covering paper surrounding the tobacco rod and with secondary air channels covered by the wrapping paper on the periphery of the mouthpiece core and an apparatus for producing such an article.

In the case of an article of this type, the filter rod is surrounded by a tubular part, whose periphery contains notches extending up to the mouth end and forming channels into which issue the secondary air openings of the wrapping paper. Secondary air is also sucked in during smoking through said secondary air openings and channels.

The problem of the invention is to make an article of the aforementioned type easy to produce, whilst having effective secondary air channels.

SUMMARY OF THE INVENTION

The invention is characterized in that the wrapping paper is airtight and has a thickness of from one tenth to one millimeter and that the inside of the wrapping paper has notches extending up to the wrapping paper end remote from the mouth and channels are formed which in the end remote from the mouth have inlets for the entry of the sucked-in secondary air into the channels.

The channels are easy to produce because they only require a correspondingly stampable wrapping paper in which the notches are either stamped from the outset or during the actual production of the article. The secondary air channels are effective because they are open towards the end remote from the mouth so that the desired secondary air can enter there without any significant air resistance.

By the varying construction of the channels the secondary air can pass in different ways to the mouth end of the article. It is in particular possible to have a separate guidance from the main flow smoke or a metered mixing of the secondary air with the main flow smoke on the way to the mouth end.

The said article is preferably a cigarette, but can also be a cigar or other rod-like smoking article.

The mouthpiece core can be filled with filter material and/or tobacco, but can also be hollow.

By pressing together the channels the smoker can reduce the secondary air. To ensure that this does not take place unintentionally and to an undesired extent according to a preferred embodiment the notches terminate at a distance from the mouth end of the wrapping paper. The secondary air can enter the interior of the mouthpiece core through air perforations on the core periphery or through gaps between the core and the tobacco rod or within the said core and from there can pass with the main flow smoke to the mouth end. It has proved advantageous to give the channels or notches dimensions by which the channels are uniformly distributed over the mouthpiece core periphery, extend in the longitudinal direction of the core and at the end remote from the mouth extend over twenty-five to sixty percent of the core periphery. Since, due to the notching the wrapping paper is relatively thick if the latter is, in preferred manner, adhered with an overlap, it is recommended that the wrapping paper be made thinner in the vicinity of the overlap in the areas between the notches, so that the paper is not made unnecessarily thick due to the overlap.

It is easy to reequip a known apparatus for producing rod-like, smoking articles, e.g. filter cigarettes into an apparatus capable of producing smoking articles according to the present invention it merely being necessary to incorporate a stamping mechanism.

The wrapping paper can be made desirably thinner in the vicinity of the overlap through a corresponding construction of the stamping mechanism.

It is desirable to effect glue application for glueing the wrapping paper in such a way that no glue passes into the vicinity of the channels, thereby ensuring that the latter are not blocked by undesired glue.

BRIEF DESCRIPTION OF THE DRAWINGS

FIG. 1 is a longitudinal sectional view taken along line I—I of FIG. 2 of an article according to the invention in the form of a filter cigarette;

FIG. 2 is a view taken along line II—II of FIG. 1;

FIG. 2*a* is a view like FIG. 2 showing a detail of the overlap portion of the wrapping paper;

FIG. 3 is a plan view of the inside of a double-wide wrapping paper strip, from which is cut the wrapping paper for the filter cigarette of FIG. 1;

FIG. 4 is a view in accordance with arrow III of FIG. 3;

FIG. 5 is a view like FIG. 4 showing an alternate notch cross-sectional shape;

FIG. 6 is a view like FIG. 5 showing another alternate notch cross-sectional shape;

DETAILED DESCRIPTION OF THE PREFERRED EMBODIMENT

Figure 7:
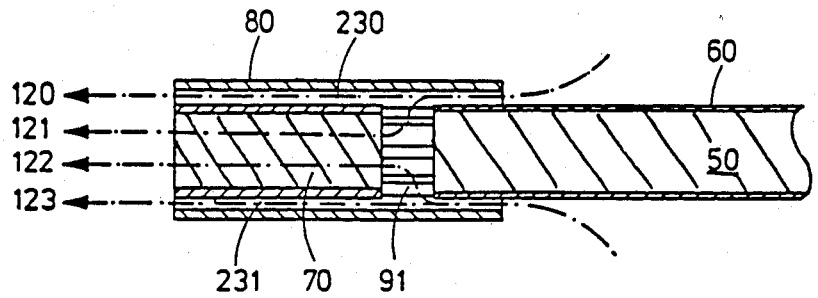
FIGS. 7 to 23 each shows a view like FIG. 1 and illustrates an alternate embodiment of an article in the form of a filter cigarette.

Refer now to FIG. 1 wherein is shown mouthpiece core 1 in the form of a filter rod, which is permeable to air in the direction of rod axis 2 and over its periphery is enveloped by an airtight wrapper 3. A tobacco rod 5 enveloped by an airtight covering paper 4 extends as an axial extension to mouthpiece core 1. Between mouthpiece core 1 and tobacco rod 5 a gap 6 is provided which extends over the entire cross-section of core 1. Wrapping paper 7 extends over the entire length of mouthpiece core 1, gap 6 and an attached piece 8 of tobacco rod 5, and is placed around said parts with overlap 27 (FIG. 2) and is adhered thereto, so that the parts shown in FIG. 1 are held together in the represented manner to give a filter cigarette.

Wrapping paper 7 is airtight and according to double arrow 9 in FIG. 4 has a thickness of eight tenths of a millimeter in the preferred embodiment shown. Notches 11, 12, 13, 14, 15, 16, 17, and 18 are stamped in the inside of wrapping paper 7 and, as can be seen in FIG. 3 are spaced uniformly over the periphery, emanating from wrapping paper end 20 which is remote from the smokers mouth, extend parallel to axis 2, but do not extend to mouth end 21.

FIG. 3 shows wrapping paper 7 as part of a cutout of a wrapping strip, which is twice as wide and is divided along dotted-line axis 22. Mouth end 21 is subsequently located at axis 22.

Due to the necessity of stamping the notches the wrapping paper is relatively thick. To avoid excessive thickness, area 26 forming overlap 27 is given a reduced thickness. At, in each case, one edge of the overlap the wrapping strip is cut into portions, i.e. for overlap 27 along dotted line 28 and these portions are so dimensioned that the thick notched portion precisely fits with joint 29 about mouthpiece core 1.

Notches 11 to 18 form channels, which, at end 20 remote from the mouth, have inlets e.g. inlet 23 into which secondary air can be sucked when smoking and this air then flows in accordance with the dotted-line arrows 24, 25 of FIG. 1, initially along the channels into gap 6 and from there, mixed with the main flow smoke, to mouthpiece core 1. As can be gathered from FIGS. 2 and 4 the stamped notches are cross-sectionally shaped like a circle portion. However, as shown in FIGS. 5 and 6, other notch cross-sections are also possible.

In the case of wrapping paper 30 in FIG. 5 notches 31 have a triangular cross-section and in the case of wrapping paper 32 of FIG. 6 notches 33 are approximately rectangular.

If the channels are given the most suitable dimensions they extend uniformly over the periphery of the mouthpiece core, extend in the longitudinal direction of said core and at the end remote from the mouth extend over twenty-five to sixty percent of the core periphery.

In the embodiment of FIG. 1, the channels formed by the notches do not extend up to mouth end 21. They are in fact blocked from mouth end 21 by adhesion of unnotched mouth-side area 34 (FIG. 3) to the mouthpiece core. Since, as a result of airtight wrapper 3 the secondary air cannot pass through the periphery into the mouthpiece core, in accordance with arrows 24, 25 the secondary air is forced through gap 6 in the longitudinal direction of core 1, wherein it mixes with the main flow smoke.

Other guidance arrangements for the secondary air and other constructions of the mouthpiece core are possible. Preferred modifications are illustrated by FIGS. 7 to 23. In these embodiments channels are produced by the notches along the inside of the wrapping paper, as described in the text relative to FIGS. 1 to 6. Unless otherwise stated hereinafter the embodiments of FIGS. 7 to 23 are constructed in exactly the same way as the embodiment of FIG. 1.

According to FIG. 7, gap 91 is formed between tobacco rod 50 enveloped by covering paper 60 and mouthpiece core 70. By means of notched wrapping paper 80, channels 230 and 231 are formed from the end remote from the mouth to that close to it. Secondary air passes through channels 230 and 231 in accordance with arrows 120 and 123 directly to the mouth end and, in addition as represented by arrows 121 and 122, to the mouth end via the gap wherein the secondary air is mixed with the main flow smoke.

Figure 8:
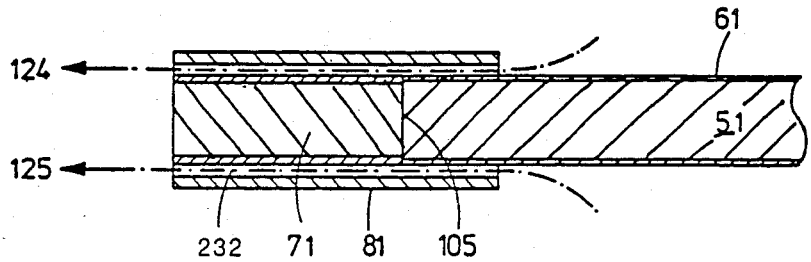

According to FIG. 8, tobacco rod 51 enveloped by covering paper 61 is joined to mouthpiece core 71 by joint 105. The notches of wrapping paper 81 extend over the entire length of paper 61, so that channels 232 extend from the end remote from the smoker's mouth to that adjacent to it and the secondary air flows according to arrows 124 and 125.

Figure 9:
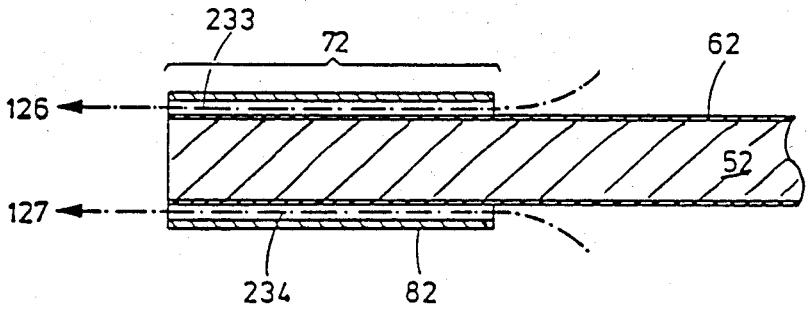

According to FIG. 9 tobacco rod 52 enveloped by covering paper 62 extends over the entire cigarette length. The tobacco rod end close to the smoker's mouth forms mouthpiece core 72. Wrapping paper 82 is notched in such a way that channels 234 and 233 passing from the end remote from the mouth to that close to the mouth are formed and the secondary air can flow in accordance with arrows 126 and 127.

In the embodiments of FIGS. 7, 8, and 9 the mouthpiece core is peripherally airtight.

Figure 10:
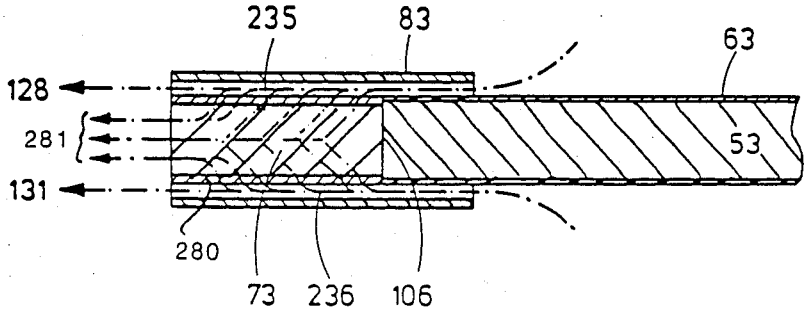

According to FIG. 10, mouthpiece core 73 is provided, whose wrapper 280 is permeable to air. Tobacco rod 53, enveloped by covering paper 63, is joined by joint 106 to mouthpiece core 73. The notches of wrapping paper 83 form continuous channels through which the secondary air can directly flow according to arrows 128 and 131. In addition, secondary air can flow through air-permeable wrapper 280 into the interior of mouthpiece core 73 as represented by arrows 281.

Figure 11:
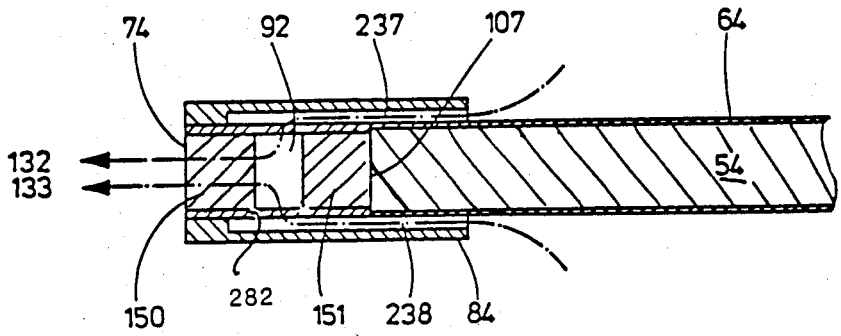

According to FIG. 11 tobacco rod 54 enveloped by wrapping paper 64 is joined by joint 107 to mouthpiece core 74, formed by two filter sections 150 and 151, between which there is a gap 92. In this and in each embodiment of the invention, the filter section may be composed of fibrous, baffled, or other suitable type of filter or, alternatively by tobacco. In the vicinity of gap 92 wrapper 282 is airtight. However, wrapper 282 is permeable to air in the vicinity of compartments 150 and 151. The notches of wrapping paper 84 pass from the end remote from the mouth and pass beyond gap 92, but not completely up to the mouth end, so that channels 237 and 238 are formed through which the secondary air can be sucked according to arrows 132 and 133, so that it passes through compartment 150.

Figure 12:
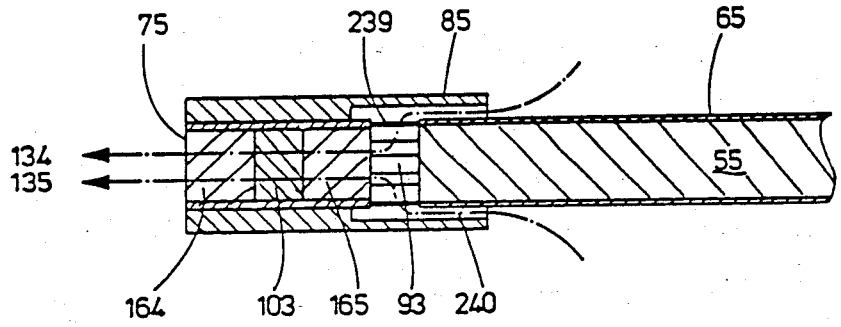

In FIG. 12 gap 93 is left between tobacco rod 55, enveloped by covering paper 65, and mouthpiece core 75. Mouthpiece core 75 includes three filter sections 103, 164 and 165. Channels 239 and 240 formed by the notches of wrapping paper 85 start from the end remote from the smoker's mouth, pass over gap 93 to the level of filter section 165 remote from the mouth, so that the secondary air flows through the complete mouthpiece core in accordance with arrows 134 and 135.

Figure 13:
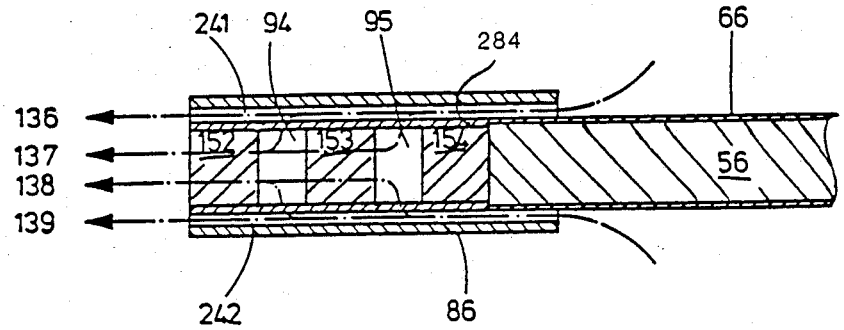

According to FIG. 13 tobacco rod 56, enveloped by covering paper 66, borders the mouthpiece core, including three filter sections 152, 153 and 154 with gaps 94 and 95 between them. Wrapper 284 enveloping the mouthpiece core is permeable to air in the vicinity of gaps 94 and 95. The notches in wrapping paper 86 form continuous channels 241 and 242, so that on the one hand secondary air can flow along the channels in accordance with arrows 136 and 139 and on the other hand through gaps 94 and 95 in accordance with arrows 137 and 138.

Figure 14:
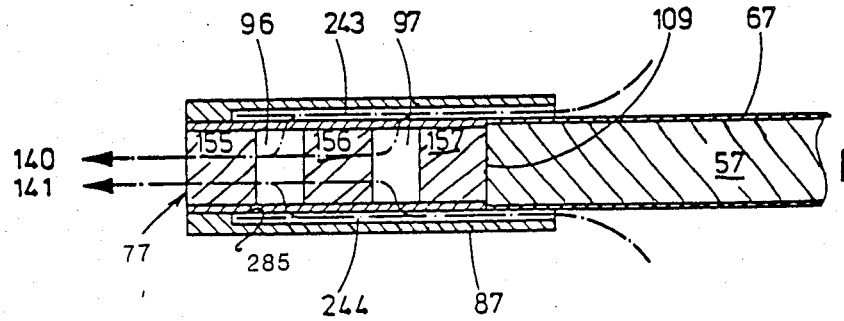

According to FIG. 14 tobacco rod 57 enveloped by covering paper 67, is adjacent at joint 109 to mouthpiece core 77, which includes three filter sections 155, 156 and 157 with gaps 96 and 97 between them. Wrapper 285 of the mouthpiece core is permeable to air in the vicinity of gaps 96 and 97. Channels 243 and 244 formed by the notches extend from the end remote from the smoker's mouth to filter section 155 and terminate before reaching the mouth end. As a result the secondary air is forced to flow through filter section 156 and 155 in accordance with arrows 140 and 141.

Figure 15:
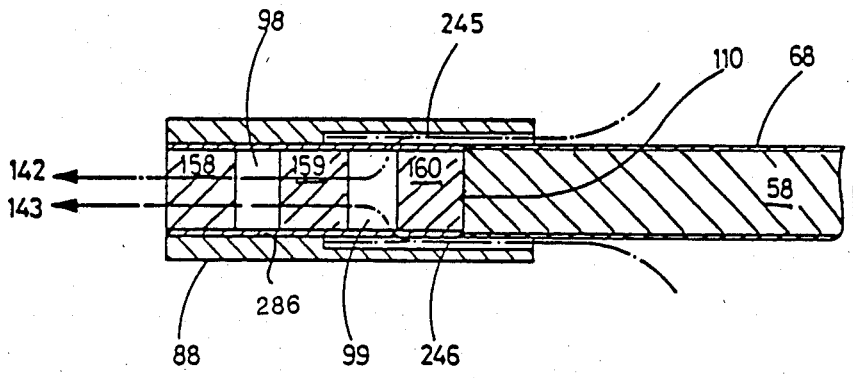

According to FIG. 15 tobacco rod 58, enveloped by covering paper 68, is adjacent at joint 110 to the mouthpiece core which includes three filter sections 158, 159 and 160 separated by gaps 98 and 99. The notches of wrapping paper 88 form channels 245 and 246 extending from the end remote from the mouth to the middle filter section 159. Mouthpiece core wrapper 286 is permeable to air in the vicinity of gap 99, so that the secondary air is forced to flow through filter sections 158 and 159 in accordance with arrows 142 and 143.

Figure 16:
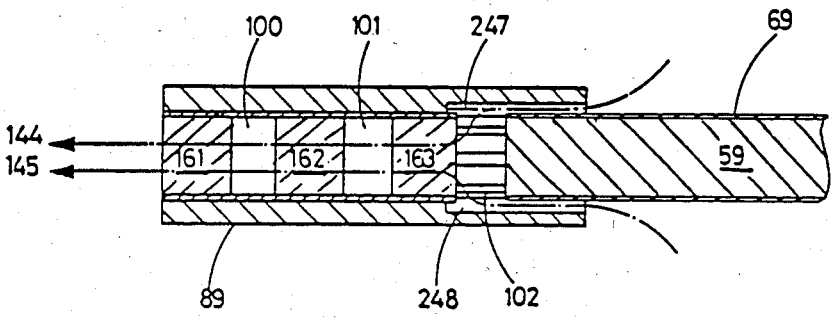

According to FIG. 16 tobacco rod 59, enveloped by covering paper 69, does not extend up to the mouthpiece core, gap 102 being formed therebetween. The mouthpiece core includes filter sections 161, 162, and 163 separated by gaps 100 and 101. Channels 247 and 248 formed by the notches of wrapping paper 89 extend from the end remote from the mouth to filter section 163, thus forcing the secondary air through the complete mouthpiece core in accordance with arrows 144 and 145.

Figure 17:
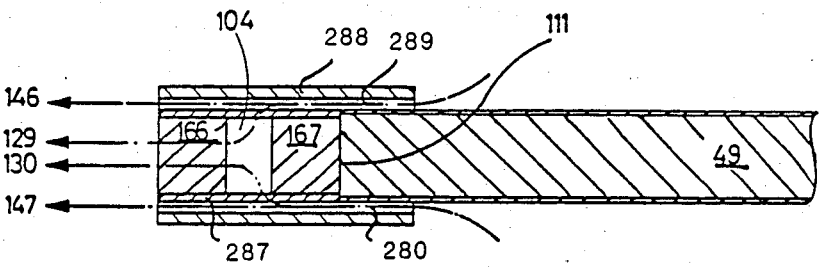

According to FIG. 17, tobacco rod 49 adjoins the mouthpiece core at joint 111. The core includes two filter sections 166 and 167 separated by gap 104. Wrapper 287 is permeable to air in the vicinity of gap 104. The notches of wrapping paper 288 extend over the entire length of the paper, so that channels 289 and 290 are formed and the secondary air flows in accordance with arrows 146, 147, 129 and 130.

Figure 18:
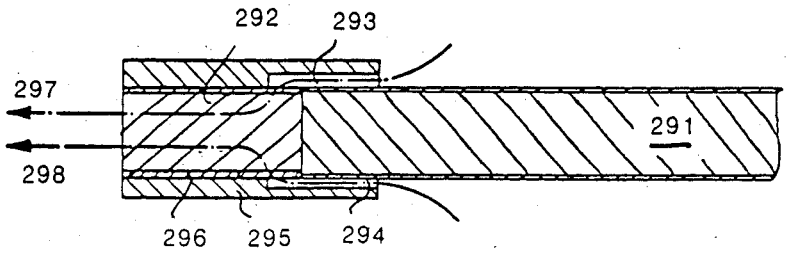

According to FIG. 18 tobacco rod 291 borders the mouthpiece core 292 and channels 293 and 294 of wrapping paper 295 extend from the end of the paper remote from the mouth to the end of core 292 remote from the mouth. Wrapper 296 of the core is permeable to air, so that the secondary air flows in accordance with arrows 297 and 298.

Figure 19:
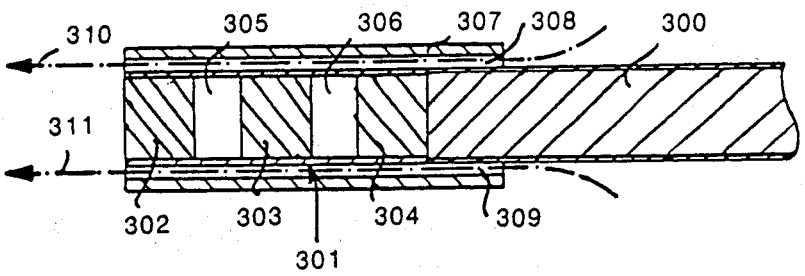

According to FIG. 19 tobacco rod 300 borders mouthpiece core 301 comprising three filter section 302, 303 and 304 being separated by gaps 305 and 306. The notches of wrapping paper 307 lead to the formation of through channels 308 and 309 and the secondary air flows in accordance with arrows 310 and 311.

Figure 20:
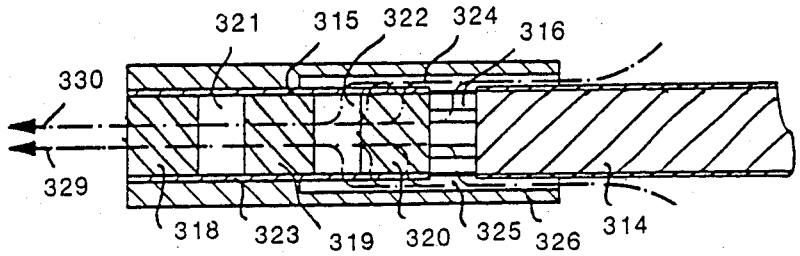

According to FIG. 20 between tobacco rod 314 and mouthpiece core 315 a gap 316 is formed. Core 315 includes filter sections 318, 319 and 320 separated by gaps 321 and 322. Wrapper 323 is permeable to air. The channels 324 and 325 of wrapping paper 326 extends to the middle filter section 319, so that the sucked-in secondary air flows in accordance with arrows 330 and 329.

Figure 21:
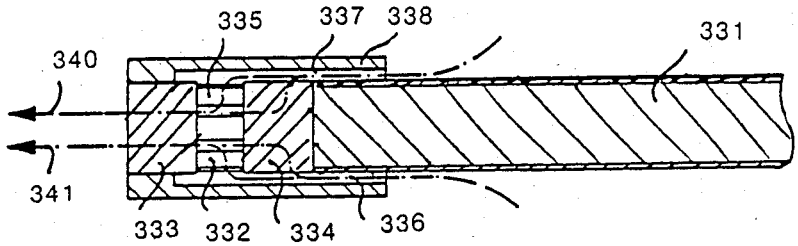

According to FIG. 21, the tobacco rod 331 is adjacent to the mouthpiece core 332 comprising the two filter sections 333 and 334, gap 335 being formed therebetween. Channels 336 and 337 of wrapping paper 338 extend from the end remote from the mouth to filter section 333, and terminate before reaching the mouth end of core 332. Filter section 334 is peripherally permeable to air, so that the secondary air flows in accordance with arrows 340 and 341.

Figure 22:
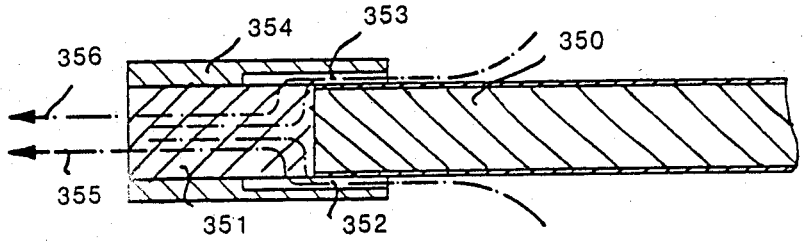

According to FIG. 22, tobacco rod 350 adjoins mouthpiece core 351, which in this embodiment is also peripherally permeable to air. Channels 352 and 353 of wrapping paper 354 do not extend to the mouth end, so that secondary air flows in accordance with arrows 355 and 356.

Figure 23:
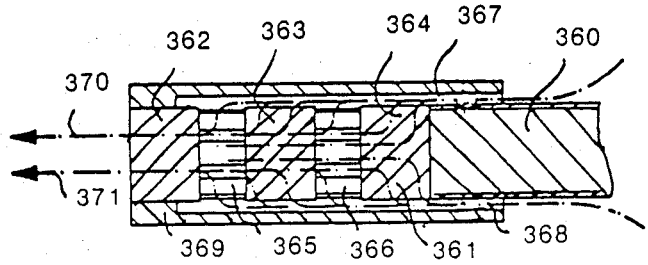

According to FIG. 23, tobacco rod 360 adjoins mouthpiece core 361 which includes three filter sections 362, 363 and 364 separated by gaps 365 and 366. The filter sections are peripherally permeable to air. Channels 367 and 368 of wrapping paper 369 do not extend to the mouth end, extending only to compartment 362, so that the sucked-in secondary air flows in accordance with arrows 370 and 371.

The mouthpiece core filter sectins of FIGS. 2, 8 and 10 to 23 may be filled with filter material or tobacco, whilst the gaps between the filter sections are recessed cavities. The mouthpiece cores of FIGS. 21, 22 and 23 have a wrapper, whereas the others have no wrapper.

Filter cigarettes of this type can be produced with known filter cigarette production machines by using an adequately thick, internally notched wrapping paper instead of an internally smooth wrapping paper. This can be achieved by replacing the conventional wrapping paper reel by a reel having a notched wrapping paper.

The notches can also be stamped into the wrapping paper strip removed from the reel, as will now be explained relative to FIGS. 24 to 28.

Figure 24:
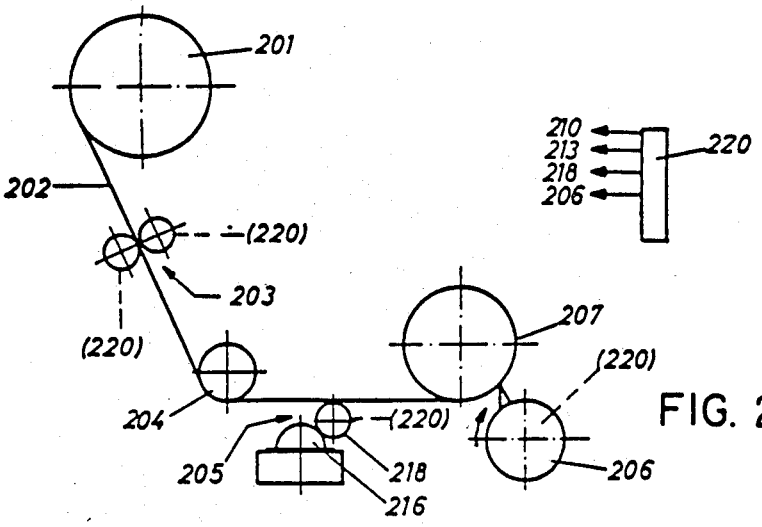
FIG. 24 is a schematic view of an apparatus for producing a filter cigarette according to the present invention.

In FIG. 24, wrapping paper reel 201 holds a supply of double-width eight tenths of a millimeter thick wrapping paper strip 202, which initially passes through a stamping mechanism 203 in which the notches, corresponding to notches 11 to 18 of FIG. 2 are stamped in the inside of strip 202. Strip 202 then passes via a guide pulley 204 to a glueing device 205, where the notched inside is glued. It then passes to a cutting mechanism 206, where it is cut into double-width wrapping paper portions 207 sufficient for two filter cigarettes, and is required for a double cigarette length comprising double-length mouthpiece cores with tobacco rods fitted to both ends. The ends of the tobacco rods are then provided with the intermediate double-length mouthpiece core enveloped by the double-width wrapping paper portion 207, followed by cutting into individual cigarettes, this taking place centrally in accordance with the dotted line 22 in FIG. 3.

Figure 26:
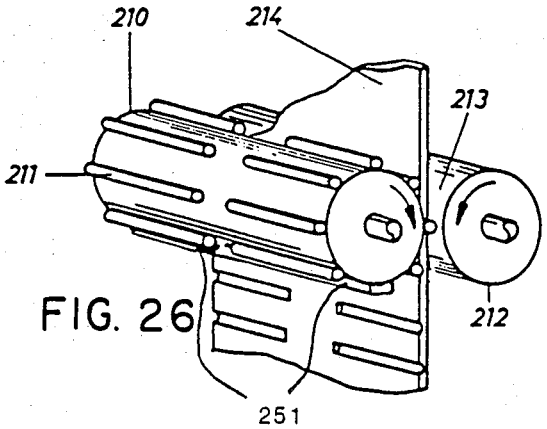
FIG. 26 is a perspective view of the stamping mechanism of FIG. 24.

Referring to FIG. 26, the stamping mechanism 203 has a stamping roller 210, which has peripheral ribs 211 corresponding to the desired notches and a continuous rib 251 corresponding to the thin portion which is sought for an overlap 27, together with a pressure roller 213 having a hard rubber shell 212 facing the overlap. The double-width wrapping strip 214 passes between the two rollers 211 and 213 driven in the direction of the arrows with a circumferential speed corresponding to the conveying speed of strip 214. Pressure roller 213 presses the strip against the stamping roller 210, whose ribs 211 form the desired notches and rib 251 forms the reduced thickness portion.

Figure 25:
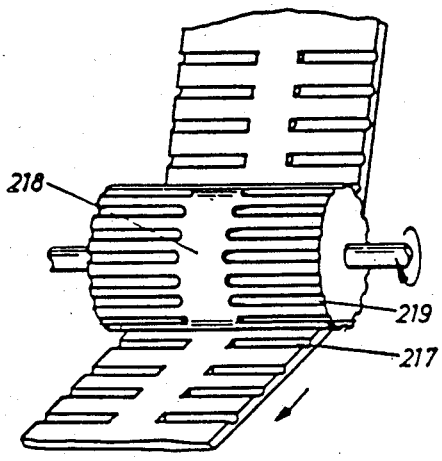
FIG. 25 is a perspective view of the glueing roller of FIG. 24.

Referring back to FIG. 24, the now stamped wrapping paper strip 214 passes to the glueing mechanism 205 constructed in such a way that the glue applied does not enter the notches, e.g. notches 217. To this end glueing mechanism 205 is equipped with glueing roller 218 which, during rotation is constantly supplied with glue from glue supply roller 216 and applies glue to wrapping paper strip 202 by its periphery rolling thereon. As shown in FIG. 25, glueing roller 218 has recesses 219 over its periphery, their arrangment matching that of notches 217. The vicinity of recesses 219 is not supplied with glue from glueing roller 218. When glueing the wrapping paper strip recesses 219 face notches 217, so that the notch surfaces are left untouched during glueing. Cutting mechanism 206 is synchronized in such a way that it always cuts in accordance with dotted line 28 in FIG. 3. The necessary synchronization takes place by means of synchronous drive 220, which synchronously drives stamping roller 210, pressure roller 213, glueing roller 218 and cutting mechanism 206, as indicated by the dotted line arrows.

The wrapping paper strip used must be thick enough to give space for the notches. A strip thickness between about three tenths and one and one half millimeter has proved adequate, a thickness of eight tenths of a millimeter being preferred.

Figure 27:
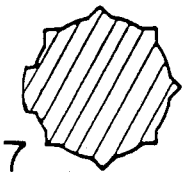
FIG. 27 is a cross-sectional view of an alternate embodiment of the stamping mechanism of FIG. 26; and, FIG. 28 is a cross-sectional view of another alternate embodiment of the stamping mechanism of FIG. 26.
Figure 28:
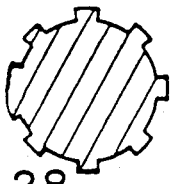

Other cross-sectional shapes for the notches are possible. In order to produce these it is merely necessary to use differently constructed stamping rollers, e.g. with a cross-section as shown in FIGS. 27 and 28.

The above description and drawings are only illustrative of preferred embodiments which achieve the objects, features and advantages of the present invention and it is not intended that the present invention be limited thereto. Any modification of the present invention which comes within the spirit and scope of the following claims are considered part of the present invention.

What is claimed as new and desired to be secured by Letters Patent of the United States is:

1. Apparatus for producing a rod-like smoking article wherein a double-length mouthpiece core with coaxially extending tobacco rods at either end is circumscribed by a pre-glued wrapping strip portion over the entire length of the double-length mouthpiece core and over adjacent portions of the two tobacco rods, said wrapping strips having an overlap region when wrapped about said core and said rods, an inside surface for contracting said core and said rods, and an outside surface, said apparatus comprising:

a reel for carrying a double-width wrapping paper strip;

means for receiving said strip from said reel and for stamping notches exclusively into said inside surface for producing a unitary strip having one smooth surface and one notched surface;

glueing means for receiving said unitary strip from said stamping means and for coating said inside surface with glue except in the notches; and means synchronized with said stamping means for receiving said glued strip from said glueing means and for cutting said glued strip into portions.

2. Apparatus as in claim 1 wherein the stamping means comprises means for stamp-forming thinner portions in the overlap region.

3. Apparatus as in claim 1 or 2 wherein the stamping means further includes a stamping roller having peripheral ribs, means for moving wrapping paper portions past the periphery of said stamping roller, and a facing pressure roller for pressing said portions against said stamping roller.

4. Apparatus as in claim 3 wherein the glueing means includes a glueing roller for rolling on the inside surface of the double-width wrapping paper strip, said glueing roller having peripheral recesses corresponding to the notches, said glueing means further comprising means for synchronously rotating said glueing roller with respect to the notches and the stamping roller such that said inside surface is coated with glue except in the notches.

* * * * *